US008094110B2

(12) United States Patent
Omata et al.

(10) Patent No.: US 8,094,110 B2
(45) Date of Patent: Jan. 10, 2012

(54) ACTIVE MATRIX DISPLAY DEVICE

(75) Inventors: Kazuyoshi Omata, Fukaya (JP); Masuyuki Oota, Hakusan (JP); Yoshiro Aoki, Kitamoto (JP)

(73) Assignee: Toshiba Matsuhita Display Technology Co., Ltd., Tokyo (JP)

( * ) Notice: Subject to any disclaimer, the term of this patent is extended or adjusted under 35 U.S.C. 154(b) by 1079 days.

(21) Appl. No.: 11/944,967

(22) Filed: Nov. 26, 2007

(65) Prior Publication Data

US 2008/0122757 A1 May 29, 2008

(30) Foreign Application Priority Data

Nov. 27, 2006 (JP) ..... 2006-319079

(51) Int. Cl.
*G09G 3/36* (2006.01)
*G09G 3/00* (2006.01)
*G09G 3/32* (2006.01)

(52) U.S. Cl. ..... 345/90; 345/55; 345/76; 345/80; 345/98; 345/100

(58) Field of Classification Search ..... 345/90, 345/98, 100, 76, 80
See application file for complete search history.

(56) References Cited

U.S. PATENT DOCUMENTS 5,295,098 A * 3/1994 Kohno ..... 365/189.05
6,483,565 B1 * 11/2002 Hidehira et al. ..... 349/141
7,221,342 B2 * 5/2007 Fish ..... 345/80
7,236,149 B2 * 6/2007 Yamashita et al. ..... 345/76
7,355,572 B2 * 4/2008 Uchino et al. ..... 345/77
7,636,073 B2 * 12/2009 Ono et al. ..... 345/76
7,659,872 B2 * 2/2010 Yamashita et al. ..... 345/80
2005/0078076 A1 * 4/2005 Kim et al. ..... 345/98
2006/0028408 A1 * 2/2006 Kim ..... 345/76
2006/0066536 A1 3/2006 Ota et al.
2007/0146251 A1 * 6/2007 Tsuge et al. ..... 345/76

FOREIGN PATENT DOCUMENTS

JP 2004-341023 12/2004

* cited by examiner

*Primary Examiner* — Richard Hjerpe
*Assistant Examiner* — Alecia D English
(74) *Attorney, Agent, or Firm* — Oblon, Spivak, McClelland, Maier & Neustadt, L.L.P.

(57) ABSTRACT

A plurality of pixel units are arranged in a matrix, each pixel unit including a display element and a pixel circuit which supplies a driving current to the display element. Each pixel circuit includes a first memory section which stores, in a write period of the pixel unit, a first driving current corresponding to a first signal current and then outputs the stored first driving current, and further stores a second driving current corresponding to a second signal current, and a second memory section which stores the first driving current output from the first memory section in the write period of the pixel unit. The pixel circuit outputs, in a light emission period of the pixel unit, a difference current between the second driving current stored in the first memory section and the first driving current stored in the second memory section to the display element as the driving current.

10 Claims, 8 Drawing Sheets

| | Write of constant current Pch | Write of constant current Nch | Write of signal | Light emission operation |
|---|---|---|---|---|
| Sa1 | high | low | high | high |
| Sb1 | low | high | low | high |
| Sc1 | high | low | high | low |
| Sd1 | high | high | high | low |

| | Write of constant current Pch | Write of constant current Nch | Write of signal | Light emission operation |
|---|---|---|---|---|
| Sa1 | high | low | high | high |
| Sb1 | low | high | low | high |
| Sd1 | high | high | high | low |

| | Write of constant current Pch | Write of constant current Nch | Write of signal | Light emission operation |
|---|---|---|---|---|
| Sa1 | high | low | high | high |
| Sb1 | high | low | high | low |
| Sd1 | high | high | high | low |

ACTIVE MATRIX DISPLAY DEVICE

CROSS-REFERENCE TO RELATED APPLICATIONS

This application is based upon and claims the benefit of priority from prior Japanese Patent Application No. 2006-319079, filed Nov. 27, 2006, the entire contents of which are incorporated herein by reference.

BACKGROUND OF THE INVENTION

1. Field of the Invention

The present invention relates generally to an active matrix display device, and more particularly to an active matrix display device which executes signal write by a current signal.

2. Description of the Related Art

In recent years, by virtue of such features as small thickness, light weight and low power consumption, there has been a rapidly increasing demand for flat-panel display devices which are typified by liquid crystal display devices. In particular, an active matrix display device, in which respective pixels are provided with pixel switches having functions of electrically separating turn-on pixels and turn-off pixels and holding video signals in the turn-on pixels, has widely been used in various types of displays including portable information devices, since a high image quality without cross-talk between neighboring pixels can be obtained.

As such a flat-panel active matrix display device, an organic electroluminescence (EL) display device using a self-luminous element has been attracting attention and has been vigorously researched and developed. The organic EL display device requires no backlight that hinders reduction in thickness and weight, and is suited to reproduction of a moving image because of its high-speed responsivity. Moreover, the organic EL display device has a feature that it can be used at a cold place because the luminance does not fall at low temperatures.

The organic EL display device includes, in each of pixels, an organic EL element functioning as a display element, and a pixel circuit which supplies a driving current to the display element. A display operation is performed by controlling the emission light luminance of the display element. The pixel circuit includes, for example, a driving transistor and an output switch, which are connected in series to the organic EL element, and a diode connection switch which is connected between the gate and drain of the driving transistor and retains a gate potential corresponding to a video signal. The driving transistor, output switch and diode connection switch are composed of, for example, thin-film transistors. As regards this organic EL display device, there is known a method in which image information is supplied to the pixel circuit by a current signal.

In the case of the display device in which signal supply is executed by a current signal, there is a possibility that sufficient signal supply cannot be executed due to a wiring capacitance of wiring for the signal supply. In particular, there is a problem that a display defect due to deficient write occurs when a write current value is low. In addition, multi-gradation display is performed, a write operation becomes difficult on a low-gradation side in which a set current amount is small, leading to defective display.

Jpn. Pat. Appln. KOKAI Publication No. 2004-341023 discloses an organic EL display device in which in order to prevent such write deficiency due to wiring capacitance, dual-system current signal supply is performed from a video signal driver, and a difference current is written as a video signal in a pixel. In this display device, a base current is written in a pixel circuit from a constant-current circuit via a video signal line, a gradation current is written in the pixel circuit from a source IC via the video signal line, and a difference current between the base current and the gradation current is written in the pixel circuit. The display element is driven by the difference current.

According to this structure, the value of a current that is supplied to the video signal line can freely be set, and the base current and the gradation current can be set at current values that are sufficiently higher than the wiring capacitance. As a result, by the large write current that is not affected by the wiring capacitance, a write operation can be performed with a small current that is the difference current.

In the display device with the above-described structure, however, the constant-current circuit needs to be provided for each of video signal lines, and the size of a peripheral edge portion of the display device, that is, a picture-frame portion of the display device, increases. There may be a case in which non-uniformity in display occurs in the signal line direction due to non-uniformity of a plurality of constant-current circuits. Moreover, since this device has the structure in which the difference current is derived at the time of writing the video signal, the device may easily suffer the influence of a feed-through current of the transistor at the time of light emission. In particular, since feed-through currents of both the first transistor that outputs a driving current corresponding to a base current and the second transistor that outputs a driving current corresponding to a gradation current are added, display non-uniformity, such as roughness and vertical streaks, is visually recognized and the display quality deteriorates.

BRIEF SUMMARY OF THE INVENTION

The present invention has been made in consideration of the above-described problems, and the object of the invention is to provide an active matrix display device with improved display quality.

According to an aspect of the invention, there is provided an active matrix display device comprising: a plurality of pixel units arranged in a matrix on a substrate, each of the pixel units including a display element and a pixel circuit which supplies a driving current to the display element; a plurality of video signal lines connected to columns of the pixel units, respectively; and a signal line driving circuit which supplies a first signal current to the pixel circuit via the video signal line and then supplies a second signal current to the pixel circuit via the video signal line, wherein each of the pixel circuits includes a first memory section which stores, in a write period of the pixel unit, a first driving current corresponding to the first signal current and then outputs the stored first driving current, and further stores a second driving current corresponding to the second signal current, and a second memory section which stores the first driving current that is output from the first memory section in the write period of the pixel unit, and each of the pixel circuits outputs, in a light emission period of the pixel unit, a difference current between the second driving current stored in the first memory section and the first driving current stored in the second memory section to the display element as the driving current.

According to the above aspect of the invention, it is possible to provide an active matrix display device which can perform a good display operation with improved display quality, without influence by wiring capacitance. Furthermore, by writing the driving current, which is written in the first memory section, into the second memory section, a constant current circuit can be dispensed with, the picture-frame region can be reduced and the non-uniformity in display due to the constant current circuit can be reduced.

Additional objects and advantages of the invention will be set forth in the description which follows, and in part will be obvious from the description, or may be learned by practice of the invention. The objects and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Referring now to the accompanying drawings, a first embodiment of the present invention is described in detail, taking an organic EL display device by way of example.

Figure 1:
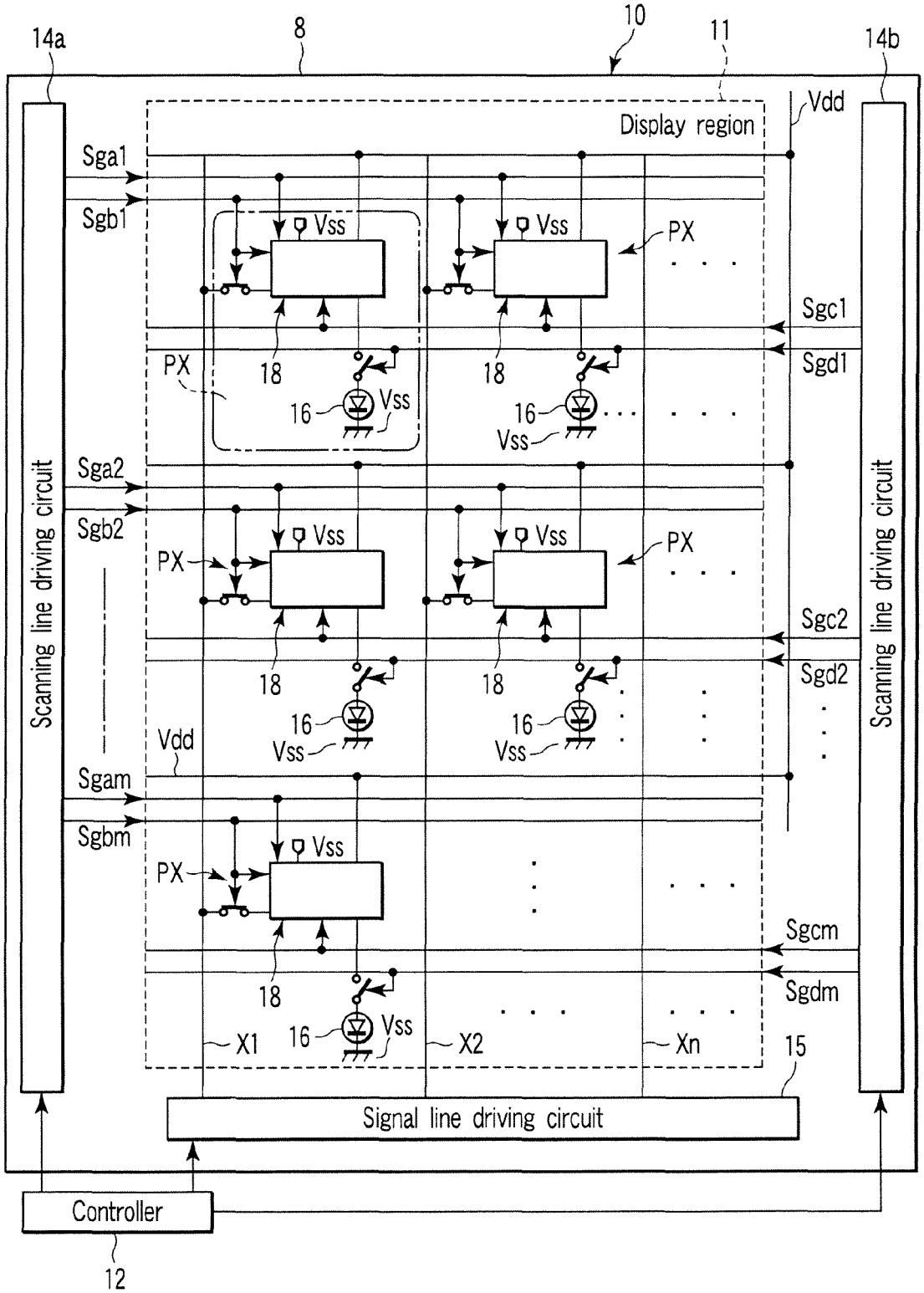
FIG. 1 is a plan view which schematically shows an organic EL display device according to a first embodiment of the present invention.

FIG. 1 is a plan view that schematically shows the organic EL display device. As shown in FIG. 1, the organic EL display device is configured, for example, as a large-sized active matrix display device with a 10-inch screen size or more. The organic EL display device includes an organic EL panel 10 and a controller 12 which controls the organic EL panel 10.

The organic EL panel 10 includes a light-transmissive insulating substrate 8 such as a glass substrate; an (m×n) number of display pixels PX which are arranged in a matrix on the insulating substrate and constitute a display region 11; an m-number of first scanning lines Sga(1-*m*), an m-number of second scanning lines Sgb(1-*m*), an m-number of third scanning lines Sgc(1-*m*) and an m-number of fourth scanning lines Sgd(1-*m*), which are individually connected to respective rows of display pixels PX; an n-number of video signal lines X(1-*n*) which are connected to respective columns of display pixels PX; scanning line driving circuits 14*a* and 14*b* which successively drive the first, second, third and fourth scanning lines Sga(1-*m*), Sgb(1-*m*), Sgc(1-*m*) and Sgd(1-*m*) in units of a row of display pixels PX; and a signal line driving circuit 15 which drives the plural video signal lines X(1-*n*). The scanning line driving circuits 14*a* and 14*b* and the signal line driving circuit 15 are integrally formed on the insulating substrate 8 in a region outside the display region 11.

Each of the display pixels PX functioning as pixel units includes a display element having an optically active layer between opposed electrodes, and a pixel circuit 18 which supplies a driving current to the display element. The display element is, for instance, a self-luminous element. In this embodiment, an organic EL element 16 including at least an organic light-emitting layer as the optically active layer is used as the display element.

Figure 2:
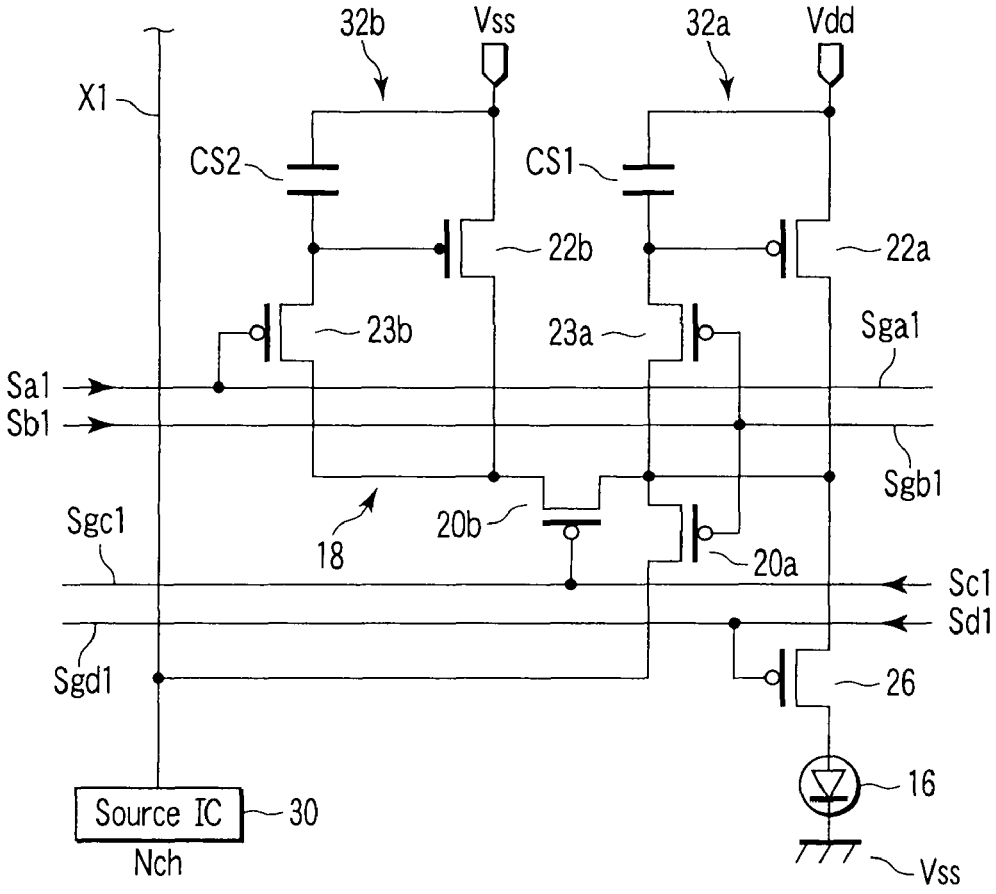
FIG. 2 is a plan view showing an equivalent circuit of a display pixel in the organic EL display device.

FIG. 2 shows an equivalent circuit of the display pixel PX. The pixel circuit 18 is a current-signal-type pixel circuit which controls light emission of the organic EL element 16 in accordance with a video signal which is composed of a current signal. The pixel circuit 18 includes a pixel switch 20*a*, a first switch 20*b*, an output switch 26, a first memory section 32*a* and a second memory section 32*b*.

The first memory section 32*a* includes a first driving transistor 22*a*, a first hold switch 23*a* and a first storage capacitance CS1 functioning as a capacitor. The second memory section 32*b* includes a second driving transistor 22*b*, a second hold switch 23*b* and a second storage capacitance CS2 functioning as a capacitor.

The pixel switch 20*a*, first switch 20*b*, first driving transistor 22*a*, first hold switch 23*a*, second hold switch 23*b* and output switch 26, with the exception of the second driving transistor 22*b*, are composed of thin-film transistors of the same conductivity type, for example, P-channel type thin-film transistors. The second driving transistor 22*b* is composed of an N-channel type thin-film transistor.

In the present embodiment, the thin-film transistors, which constitute the pixel switch 20*a*, first switch 20*b*, first driving transistor 22*a*, first hold switch 23*a*, second hold switch 23*b* and output switch 26, are all fabricated in the same steps with the same layer structure. These thin-film transistors have a top-gate structure using polysilicon as semiconductor layers. The second driving transistor 22*b* is a thin-film transistor of a top-gate structure using polysilicon as the semiconductor layer. The second driving transistor 22*b* is fabricated in the same steps with the same layer structure as the pixel switch 20*a*, etc., but is made different from the first driving transistor 22*b* by doping impurities of a different conductivity type in the source/drain regions. Each of the pixel switch 20*a*, first driving transistor 22*a*, second driving transistor 22*b*, first hold switch 23*a*, second hold switch 23*b*, first switch 20*b* and output switch 26 has a first terminal, a second terminal and a control terminal. In this embodiment, the first terminal, second terminal and control terminal are the source, drain and gate, respectively.

The first driving transistor 22*a* of the first memory section 32*a* is connected in series to the organic EL element 16 between a voltage power supply line Vdd and a reference voltage power supply line Vss. The first driving transistor 22*a* outputs a current amount corresponding to a video signal to the organic EL element. The reference voltage power supply line Vss and the voltage power supply line Vdd are set at potentials of, for example, −9V and +6V, respectively. The first storage capacitance CS1 is connected between the source and gate of the first driving transistor 22*a*, and retains a gate control potential of the first driving transistor 22*a*, which is determined by the video signal. The pixel switch 20*a* is connected between an associated video signal line X(1-*n*) and the drain of the first driving transistor 22*a*, and the gate of the pixel switch 20*a* is connected to an associated second scanning line Sgb(1-*m*). The pixel switch 20*a* is opened/closed in response to a control signal Sb(1-*m*) which is supplied from the second scanning line Sgb(1-*m*), and takes in the video signal from the associated video signal line X(1-*n*).

The first hold switch 23*a* is connected between the drain and the gate of the first driving transistor 22*a*, and the gate of the first hold switch 23*a* is connected to the scanning line Sgb(1-*m*). The first hold switch 23*a* is turned on ("conductive") and off ("non-conductive") in accordance with a control signal Sb(1-*m*) from the second scanning line Sgb(1-*m*), and the first hold switch 23*a* controls connection/disconnection between the gate and drain of the first driving transistor 22*a*, and restricts current leak from the first storage capacitance CS1.

The second driving transistor 22*b* of the second memory section 32*b* is connected in series to the organic EL element 16 between two reference voltage power supply lines Vss, and outputs a current amount corresponding to the video signal. The second storage capacitance CS2 is connected between the source and gate of the second driving transistor 22*b*, and retains a gate control potential of the second driving transistor 22*b*, which is determined by the video signal.

The second hold switch 23*b* is connected between the drain and gate of the second driving transistor 22*b*, and the gate of the second hold switch 23*b* is connected to the first scanning line Sga(1-*m*). The second hold switch 23*b* is turned on ("conductive") and off ("non-conductive") in accordance with a control signal Sa(1-*m*) from the first scanning line Sga(1-*m*), and the second hold switch 23*b* controls connection/disconnection between the gate and drain of the second driving transistor 22*b* and restricts current leak from the second storage capacitance CS2.

The first switch 20*b* is connected between the source of the first hold switch 23*a*, the source of the second driving transistor 22*b* and the drain of the first driving transistor 22*a*, and the gate of the first switch 20*b* is connected to the third scanning line Sgc(1-*m*). The first switch 20*b* is turned on ("conductive") and off ("non-conductive") in accordance with a control signal Sc(1-*m*) from the third scanning line Sgc(1-*m*), and controls connection/disconnection between the second driving transistor 22*b*, first driving transistor 22*a* and output switch 26. Specifically, the first switch 20*b* controls connection/disconnection between the second driving transistor 22*b* and first driving transistor 22*a*, and connection/disconnection between the second driving transistor 22*b* and the display element 16.

The output switch 26 is connected between the drain of the first driving transistor 22*a* and one of the electrodes of the organic EL element 16, i.e. the anode in this example, and the gate of the output switch 26 is connected to the fourth scanning line Sgd(1-*m*). The output switch 26 is turned on/off by a control signal Sd(1-*m*) from the fourth scanning line Sgd (1-*m*), and controls connection/disconnection between the first driving transistor 22*a* and second driving transistor 22*b*, on one hand, and the organic EL element 16, on the other hand. Specifically, the output switch 26 controls connection/disconnection between the current path on the first driving transistor 22*a* side and the current path on the second driving transistor 22*b* side, on one hand, and the display element 16, on the other hand.

Figures 3, 4:
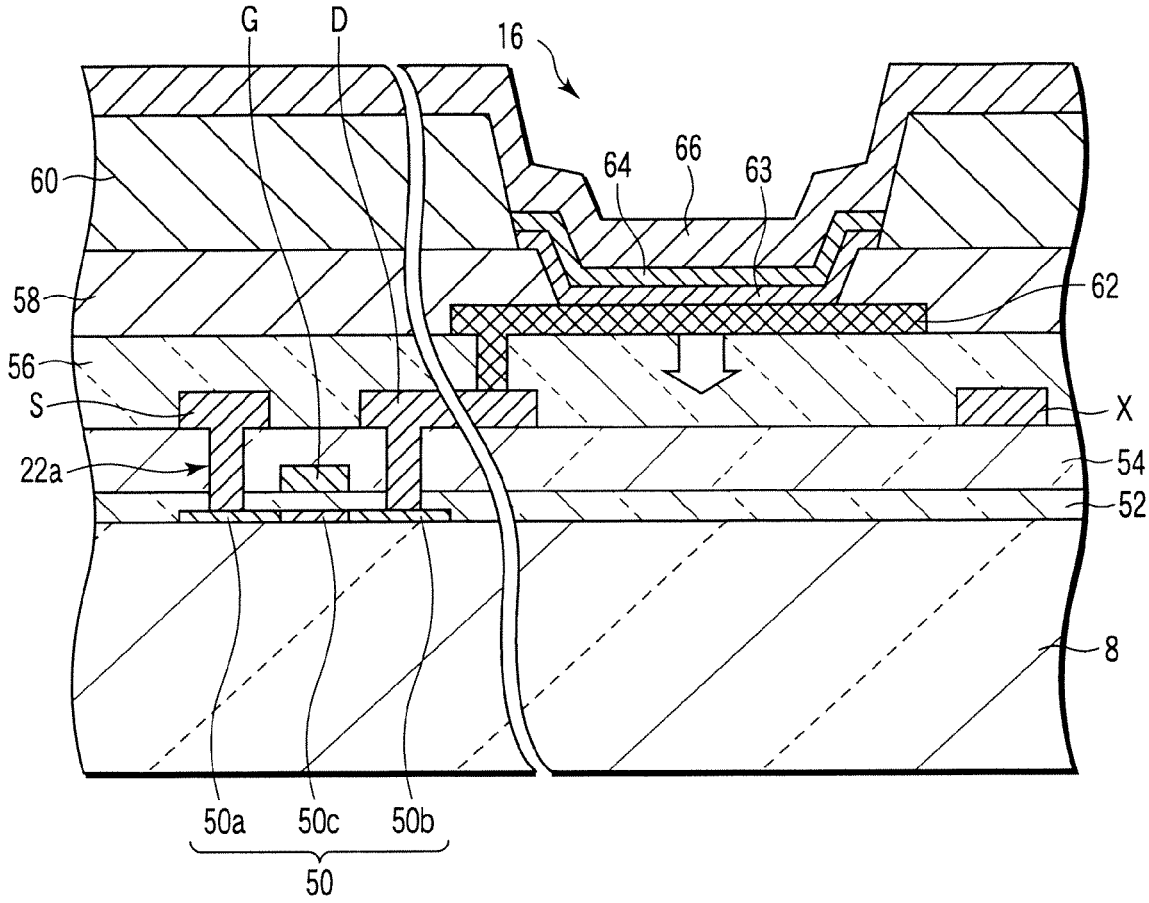
FIG. 3 is a cross-sectional view showing a driving transistor and an organic EL element in the organic EL display device.
FIG. 4 is a table showing on/off (high/low) timings of control signals in the organic EL display device.

Next, referring to FIG. 3, the structures of the first driving transistor 22*a* and the organic EL element 16 are described in detail. FIG. 3 shows a cross section of the display pixel PX including the organic EL element 16.

The P-channel thin-film transistor, which constitutes the first driving transistor 22*a*, includes a semiconductor layer 50 which is formed of polysilicon on the insulating substrate 8. The semiconductor layer 50 includes a source region 50*a*, a drain region 50*b* and a channel region 50*c* which is positioned between the source region and the drain region. A gate insulation film 52 is formed on the semiconductor layer 50. A gate electrode G is provided on the gate insulation film so as to be opposed to the channel region 50*c*. An interlayer insulation film 54 is formed on the gate electrode G, and a source electrode (source) S and a drain electrode (drain) D are provided on the interlayer insulation film 54. The source electrode S and the drain electrode D are connected to the source region 50*a* and drain region 50*b* of the semiconductor layer 50, respectively, via contacts which are formed so as to penetrate the interlayer insulation film 54 and gate insulation film 52. The drain electrode D of the first driving transistor 22*a* is connected to the output switch 26 via a wiring line which is formed on the interlayer insulation film 54.

Each of the thin-film transistors, which constitute the pixel switch 20*a*, first hold switch 23*a*, second hold switch 23*b*, first switch 20*b* and output switch 26, is formed with the same structure as described above. Although the second driving transistor 22*b* is formed to have the same structure as described above, an LDD region may additionally be provided.

A plurality of wiring lines including the video signal lines X(1-*n*) are provided on the interlayer insulation film 54. In addition, a protection film 56 is formed on the interlayer insulation film 54 so as to cover the source electrode S, drain electrode D and the wiring lines. A hydrophilic film 58 and a partition-wall film 60 are successively stacked on the protection film 56.

The organic EL element 16 has such a structure that an organic light-emitting layer 64 including a luminescent organic compound is interposed between an anode 62 and a cathode 66. The anode 62 is formed of a transparent electrode material such as ITO (Indium Tin Oxide), and is provided on the protection film 56. Those portions of the hydrophilic film 58 and partition-wall film 60, which are opposed to the anode 62, are removed by etching. An anode buffer layer 63 and the organic light-emitting layer 64 are formed on the anode 62. Further, the cathode 66, which is formed of a silver-aluminum alloy, is stacked on the organic light-emitting layer 64 and partition-wall film 60.

In the organic EL element 16 having the above-described structure, when holes which are injected from the anode 62 and electrons which are injected from the cathode 66 are recombined in the organic light-emitting layer 64, organic molecules, of which the organic light-emitting layer is formed, are excited and excitons are generated. Light is generated in a radiative deactivation process of the excitons, and the generated light is emitted to the outside from the organic light-emitting layer 64 via the transparent anode 62 and insulating substrate 8.

It is also possible to impart light transmissivity to the cathode 66, thereby emitting light to the outside from the surface thereof opposed to the insulating substrate 8. Besides, it is also possible to adopt an inverted stack-type structure in which the cathode 66 is disposed, relative to the anode 62, on the insulating substrate 8 side. In any case, the light emission surface side needs to be formed of a transparent electrically conductive material. For example, in the case where the cathode 66 is disposed on the light emission surface side, this can be realized by reducing the thickness of an alkaline earth metal or a rare earth metal to such a degree as to have light transmissivity.

The controller 12 shown in FIG. 1 is formed on a printed circuit board that is disposed on the outside of the organic EL panel 10. The controller 12 controls the scanning line driving circuits 14*a* and 14*b* and the signal line driving circuit 15. The controller 12 receives a digital video signal and a sync signal, which are supplied from outside, and generates, based on the sync signal, a vertical scanning control signal for controlling a vertical scanning timing, and a horizontal scanning control signal for controlling a horizontal scanning timing. The controller 12 supplies the vertical scanning control signal and the horizontal scanning control signal to the scanning line driving circuits 14*a* and 14*b* and the signal line driving circuit 15, and supplies the digital video signal to the signal line driving circuit 15 in sync with the horizontal and vertical scanning timing.

The scanning line driving circuit 14*a*, 14*b* includes a shift register and an output buffer, and successively transfers a horizontal scanning start pulse, which is supplied from outside, to the next stage. As shown in FIG. 1 and FIG. 2, the scanning line driving circuit 14*a*, 14*b* supplies four kinds of control signals, namely, controls signals Sa(1-*m*), Sb(1-*m*), Sc(1-*m*) and Sd(1-*m*), to display pixels PX of each row via the output buffer. Thereby, the first, second, third and fourth scanning lines Sga(1-*m*), Sgb(1-*m*), Sgc(1-*m*) and Sgd(1-*m*) are driven by the controls signals Sa(1-*m*), Sb(1-*m*), Sc(1-*m*) and Sd(1-*m*) in mutually different 1-horizontal scanning periods.

The signal line driving circuit 15 converts a video signal, which is successively obtained in each horizontal scanning period by the control of the horizontal scanning control signal, to an analog-format signal, thus producing a first signal current Io and a second signal current Io+Isig. The signal line driving circuit 15 supplies the first and second signal currents to the plural video signal lines X(1-*n*) in a parallel fashion. As shown in FIG. 2, the signal line driving circuit 15 includes a plurality of source ICs 30 which are connected to the respective video signal lines X(1-*n*). Each source IC 30 is formed of a variable N-channel IC and functions as a current supply unit. The source IC 30 supplies the first signal current Io as a base current and the second signal current Io+Isig as a gradation current to the pixel circuit 18 via the video signal line X(1-*n*). The first signal current Io and the second signal current Io+Isig are time-divided and supplied to the plural display pixel PX with use of the same video signal line X(1-*n*).

The current amounts of the first signal current Io and the second signal current Io+Isig are set at such current amounts as not to cause write deficiency. Specifically, the current amount of each of the first signal current Io and the second signal current Io+Isig is set at a value greater than a charge amount which corresponds to a value obtained by multiplying the wiring capacitance (Cp) of the video signal line X by a potential variation between a maximum gradation display and a minimum gradation display (maximum voltage variation $\Delta V$) in one horizontal scanning period (t) ($Io(Io+Isig) > Cp \times \Delta V/t$). The first signal current Io and the second signal current Io+Isig are set at, for example, levels substantially equal to the driving current for effecting the maximum gradation display of the organic EL display device. For instance, the first signal current Io is set at 0.1 to 1.0 μA.

In addition, one of the first signal current Io and the second signal current Io+Isig, for example, the first signal current Io, is set to be a constant current, and the second signal current Io+Isig is set to be a signal current varying in accordance with gradations. Alternatively, the second signal current Io+Isig may be set to be a constant current, and the first signal current Io may be set to be a signal current varying in accordance with gradations. Alternatively, both the first signal current Io and the second signal current Io+Isig may be set to be variable signal currents.

In the organic EL display device with the above-described structure, the operations of the pixel circuit 18 are classified into a first signal current (P-channel) write operation, a first signal current (N-channel) write operation, a second signal current (signal) write operation, and a light emission operation.

Figure 5:
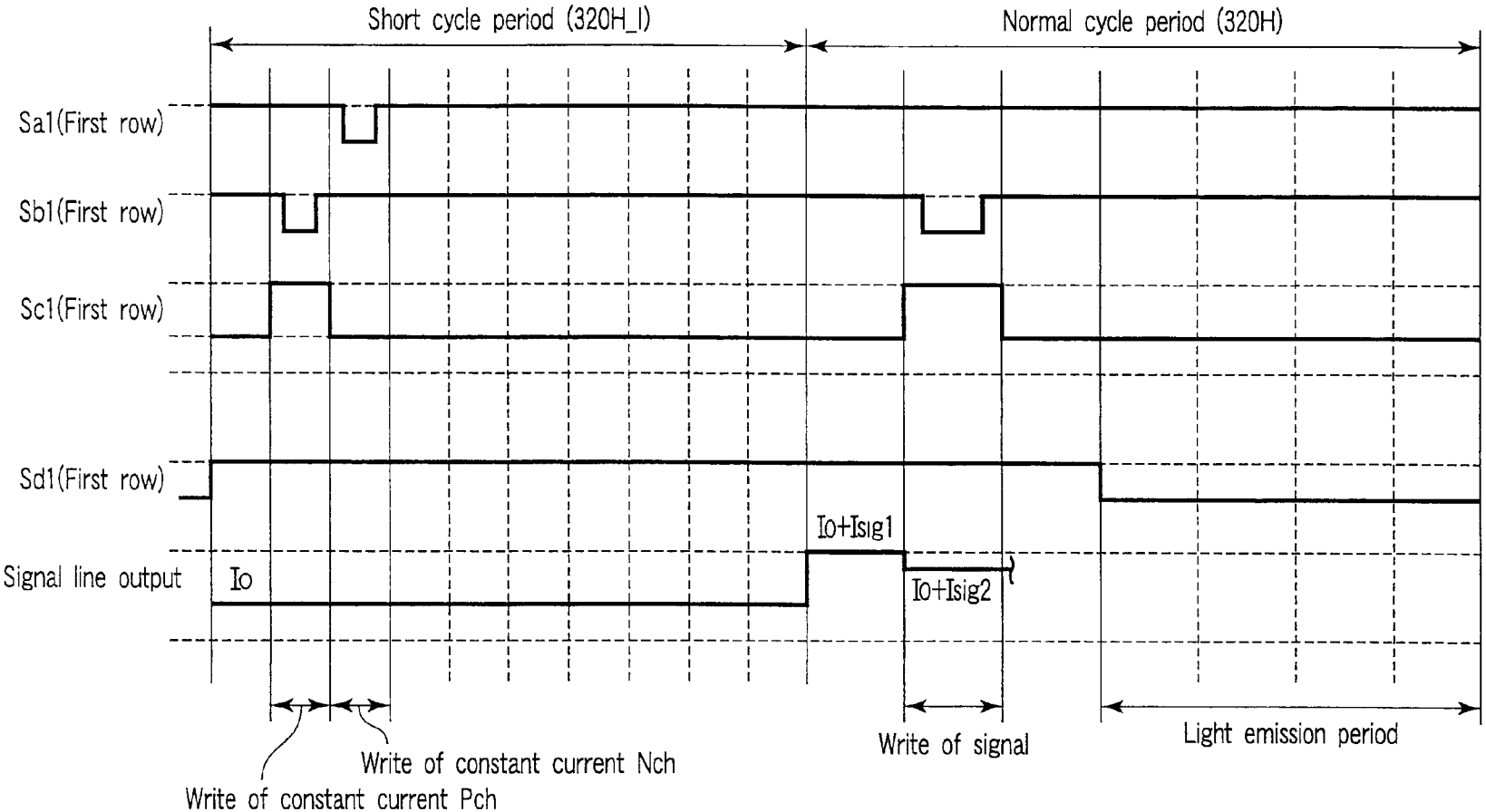
FIG. 5 is a timing chart showing on/off timings of the control signals and a signal line output.
Figure 6:
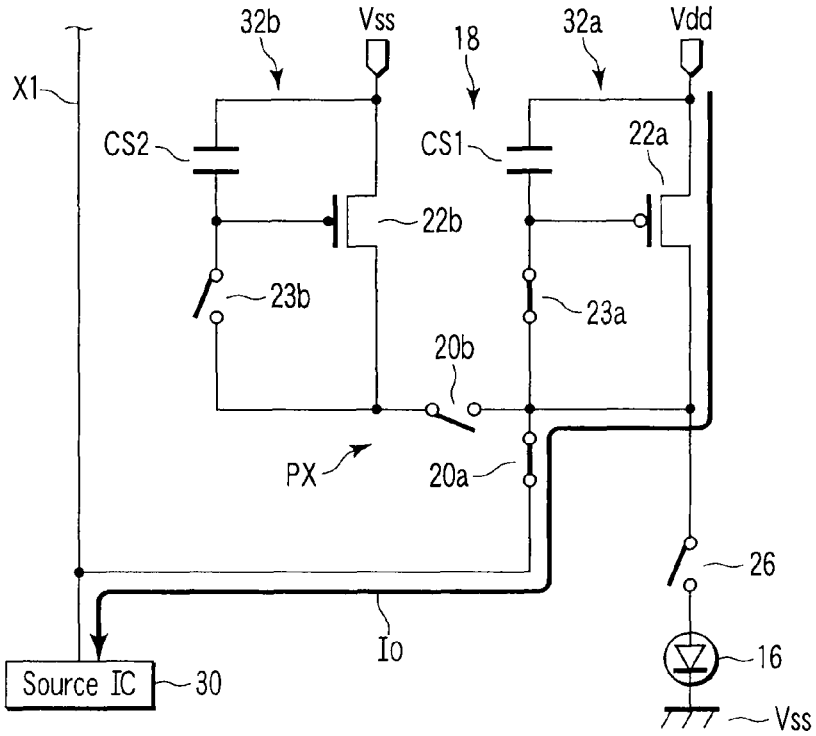
FIG. 6 is a plan view showing an equivalent circuit of the display pixel at a first signal current (P channel) write time of the organic EL display device.

FIG. 4 is a table showing on/off (high/low) timings of the control signals Sa1, Sb1, Sc1 and Sd1. FIG. 5 is a timing chart showing on/off timings of the control signals Sa1, Sb1, Sd1 and Sd1, and the signal line output. FIG. 6 schematically shows the operation of the pixel circuit 18 in the display pixel PX in the first row.

As shown in FIG. 4, FIG. 5 and FIG. 6, in the first signal current (P-channel) write operation, for example, the control signal Sb1 at a level (on-potential) which turns on the first hold switch 23*a* and pixel switch 20*a*, that is, at a low level in this example, is output from the first scanning line driving circuit 14*a* to the first-row display pixel PX. At the same time, the control signals Sa1, Sd1 and Sd1 at a level (off-potential) which turns off the second hold switch 23*b*, first switch 20*b* and output switch 26, that is, at a high level in this example, are output from the first scanning line driving circuit 14*a* and second scanning line driving circuit 14*b*. Thereby, the first hold switch 23*a* and pixel switch 20*a* are turned on ("conductive") and the second hold switch 23*b*, first switch 20*b* and output switch 26 are turned off ("non-conductive"). Thus, the first signal current write is started.

In the first signal current (P-channel) write period, the first signal current Io, which is set to be, for example, a predetermined constant current, is supplied to the video signal line X1 from the associated source IC 30 of the signal line driving circuit 15, and is supplied to the selected display pixel PX via the pixel switch 20*a*.

In the display pixel PX, the pixel switch 20*a* and first hold switch 23*a* are in the ON state, and the taken-in first signal current Io is supplied to the first driving transistor 22*a* of the first memory section 32*a* and sets the first driving transistor 22*a* in the write state. Thereby, a write current flows to the video signal line X1 from the voltage power supply line Vdd via the first driving transistor 22*a*, and the gate-source potential of the first driving transistor 22*a*, which corresponds to the current amount of the first signal current Io, is written in the first storage capacitance CS1.

Figure 7:
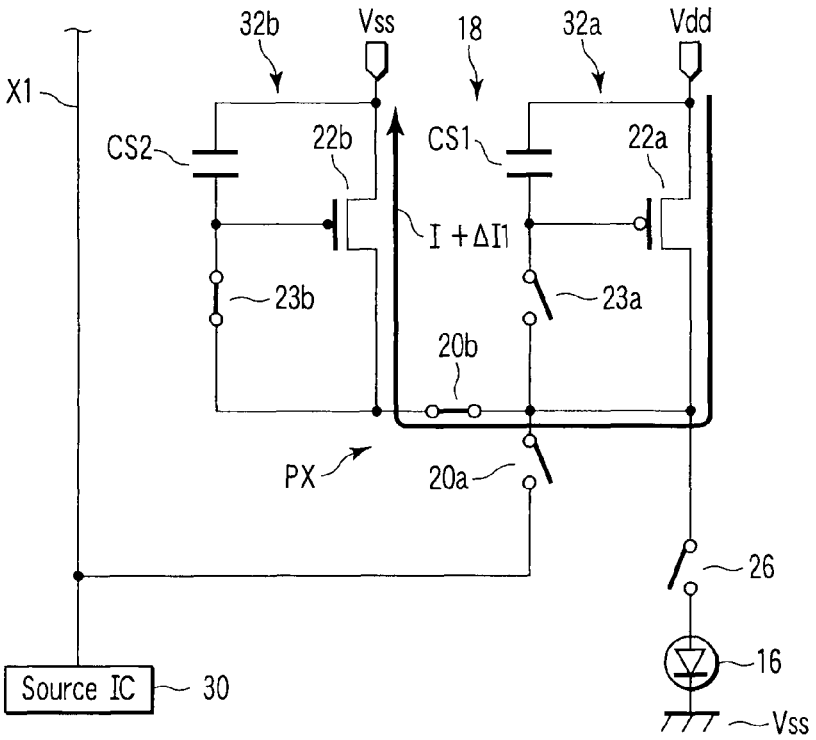
FIG. 7 is a plan view showing an equivalent circuit of the display pixel at a first signal current (N channel) write time of the organic EL display device.

Subsequently, the control signal Sb1 transitions to the off-potential (high level), and the first hold switch 23*a* and pixel switch 20*a* are turned off. Thereby, the first signal current write operation is finished. Then, as shown in FIG. 4, FIG. 5 and FIG. 7, the control signals Sa1 and Sc1 transition to the on-potential (low level), and the second hold switch 23*b* and first switch 20*b* are turned on. The output switch 26 is kept in the OFF state ("non-conductive"). Thereby, the first signal current (N-channel) write operation is started.

In the first signal current (N-channel) write period, the first driving transistor 22*a* outputs, by the gate control voltage written in the first storage capacitance CS1, a first driving current with a current amount corresponding to the first signal current Io. Thereby, the first signal current is supplied from the first memory section 32*a* to the second memory section 32*b* via the first switch 20*b*. At this time, a feed-through current ΔI1 occurring in the first driving transistor 22*a* is added, and the first driving current Io+ΔI1 is output.

In the second memory section 32*b*, the second hold switch 23*b* is in the ON state, and the taken-in first signal current Io+ΔI1 is supplied to the second driving transistor 22*b* and sets the second driving transistor 22*b* in the write state. Thereby, a write current flows from the voltage power supply line Vdd to the reference voltage power supply line Vss via the first driving transistor 22*a* and second driving transistor 22*b*, and the gate-source potential of the second driving transistor 22*b*, which corresponds to the current amount of the first signal current Io+ΔI1, is written in the second storage capacitance CS2.

Subsequently, the control signals Sa1 and Sc1 transition to the off-potential (high level), and the second hold switch 23*b* and first switch 20*b* are turned off. Thereby, the first signal current (N-channel) write operation is finished.

Figure 8:
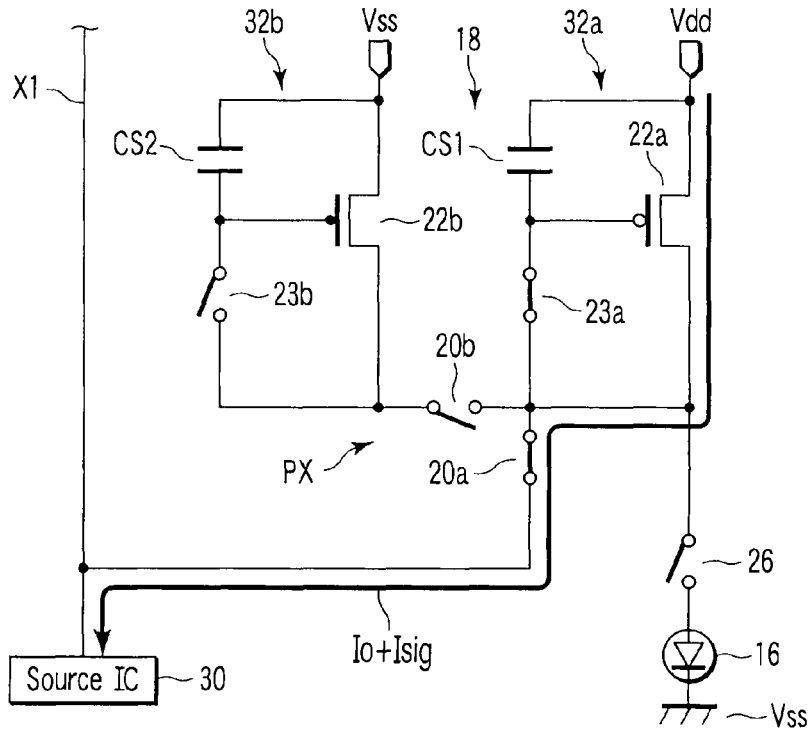
FIG. 8 is a plan view showing an equivalent circuit of the display pixel at a second signal current (signal) write time of the organic EL display device.

Then, as shown in FIG. 4, FIG. 5 and FIG. 8, the control signal Sb1 transitions to the on-potential (low level), and the first hold switch 23*a* and pixel switch 20*a* are turned on. The output switch 26 is kept in the OFF state ("non-conductive"). Thereby, the second signal current (signal) write operation is started.

In the second signal current (signal) write period, the second signal current Io+Isig, which corresponds to a desired gradation, is supplied to the video signal line X1 from the associated source IC 30 of the signal line driving circuit 15, and is supplied to the selected display pixel PX via the pixel switch 20*a*.

In the display pixel PX, the pixel switch 20*a* and first hold switch 23*a* are in the ON state, and the taken-in second signal current Io+Isig is supplied to the first driving transistor 22*a* of the first memory section 32*a* and sets the first driving transistor 22*a* in the write state. Thereby, a write current flows to the video signal line X1 from the voltage power supply line Vdd via the first driving transistor 22*a*, and the gate-source potential of the first driving transistor 22*a*, which corresponds to the current amount of the second signal current Io+Isig, is written in the first storage capacitance CS1.

Subsequently, the control signal Sb1 transitions to the off-potential (high level), and the first hold switch 23*a* and pixel switch 20*a* are turned off. Thereby, the second signal current (signal) write operation is finished.

Figure 9:
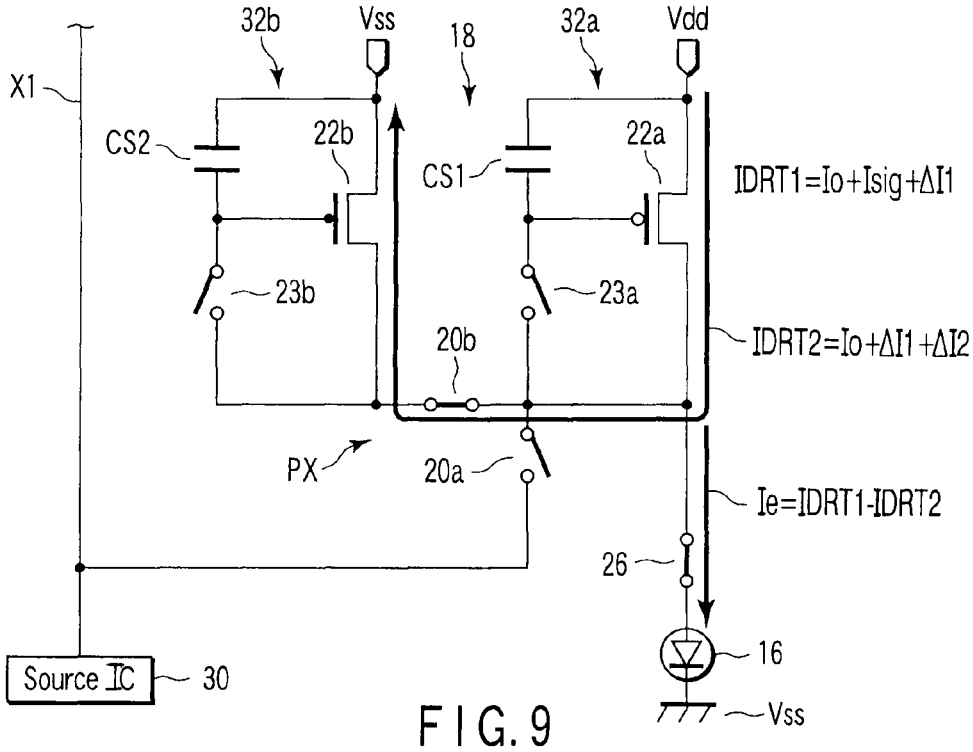
FIG. 9 is a plan view showing an equivalent circuit of the display pixel at a light emission operation time of the organic EL display device.

Then, as shown in FIG. 4, FIG. 5 and FIG. 9, the control signals Sc1 and Sd1 transition to the on-potential (low level) while the control signals Sa1 and Sb1 are in the OFF state, and first switch 20*b* and output switch 26 are turned on. Thereby, the light emission operation is started.

In the light emission period, the first driving transistor 22*a* outputs, by the gate control voltage written in the first storage capacitance CS1, a first driving current IDRT1 which corresponds to the second signal current Io+Isig. The first driving current IDRT1 has a value which is obtained by adding the feed-through current ΔI1 of the first driving transistor 22*a* to the second signal current Io+Isig.

In addition, the second driving transistor 22*b* outputs, by the gate control voltage written in the second storage capacitance CS2, a second driving current IDRT2 (=Io+ΔI1+ΔI2), which is obtained by adding a feed-through current ΔI2 of the second driving transistor 22*b* to the current amount corresponding to the first signal current Io+ΔI1, to the reference voltage power supply line Vss. Thus, the second driving current IDRT2 corresponding to the first signal current Io, which is included in the first driving current IDRT1 that is supplied through the first driving transistor 22*a*, is output to the reference voltage power supply Vss via the first switch 20*b* and second driving transistor 22*b*. In addition, a driving current Ie, which is a difference current (IDRT1−IDRT2) between the first driving current IDRT1 and the second driving current IDRT2, is supplied to the organic EL element 16 via the output switch 26. In short, the driving current, which is expressed by $$\begin{aligned} Ie &= (IDRT1 - IDRT2) \\ &= (Io + Isig + \Delta I1) - (Io + \Delta I1 + \Delta I2) \\ &= Isig - \Delta I2 \end{aligned}$$

is supplied from the pixel circuit 18 to the organic EL element 16. Thereby, the organic EL element 16 emits light, and the limit emission operation is started. The organic EL element 16 remains in the light emission state until the control signal Sd1 transitions to the off-potential after one frame period.

According to the organic EL display device having the above-described structure, in the video signal current write, after the first signal current is supplied and written in the first memory section 32*a* of the pixel circuit 18 via the video signal line, the first signal current stored in the first memory section is supplied and written in the second memory section 32*b* of the pixel circuit 18 by the first driving transistor. Further, the second signal current is supplied to the pixel circuit 18 via the video signal line, and is written in the first memory section 32*a*. At the time of light emission, the difference current between the second driving current IDRT2 corresponding to the first signal current and the first driving current IDRT1 corresponding to the second signal current is output to the display element 16 as the driving current Ie. Thus, even in the case where low-gradation light emission is performed, the current values of the first and second signal currents that are supplied to the video signal line can freely be set, and can be set at values which are sufficiently higher than the wiring capacitance of the video signal line. Therefore, even in the case where display is performed at low luminance, the signal current can sufficiently be written in a short time without influence by the wiring capacitance. Moreover, visual recognition of display defects, streaks and roughness at low luminance can be eliminated, and high-quality image display can be realized.

Also in the case where low-current write is executed after high-current write is executed in the video signal line, the write deficiency of the low-current video signal can be eliminated. For example, in the prior art, in the case where write for minimum-gradation display (black display) is executed after write for maximum-gradation display (white display) is executed, the high-gradation-side write state occurs due to write deficiency of the video signal for the minimum-gradation display (black display). As a result, a display image with trailing white display may occur. According to the present embodiment, it is possible to overcome such display defects due to write deficiency.

In each pixel circuit, at the time of the signal current write and at the time of the light emission operation, the signal current or driving current, which flows to transistors, excluding the output switch 26, can be made several times to several tens of times higher than the driving current that is supplied to the organic EL element 16. The non-uniformity in the rate of increase of current due to the Early effect or kink effect of the thin-film transistors, which constitute the first and second driving transistors 22*a* and 22*b* and other switches, becomes smaller as the current flowing in the transistors is higher. Thus, by making the current flowing in the transistor several times to several tens of times higher than the light-emission current that is supplied to the organic EL element 16, as in the present embodiment, it becomes possible to suppress the non-uniformity in the rate of increase of current in the transistor and to supply the driving current without non-uniformity to the organic EL element. As a result, the non-uniformity in luminance between the display pixels PX can be suppressed, and good image display with improved display quality can be performed.

The above-described organic EL display device is configured such that in the write of the video signal current, the first signal current is written and stored in the second driving transistor of the second memory section by the first driving transistor of the first memory section. Hence, the conventionally used constant-current circuit can be dispensed with, and the supply section can be composed of the source IC 30. Therefore, the width of the picture-frame portion of the display device can be reduced, and the size of the display region can be increased or the size of the entire device can be decreased. At the same time, the manufacturing cost can be reduced. Moreover, non-uniformity in display in the video signal line direction due to the constant-current circuit can be eliminated, and the display quality can be improved.

Besides, in the first driving transistor, the feed-through current ΔI1 occurs at the time of writing the first signal current in the second driving transistor and at the time of the light emission operation. The feed-through current ΔI1 is canceled when the difference current is output. Accordingly, the feed-through current, which contributes to the driving current Ie that is supplied to the organic EL display element, is only the feed-through current ΔI2 that occurs in the second driving transistor, and is made less than half the feed-through current in the prior art. Thereby, the rate of occurrence of display non-uniformity is less than ½ and the display quality can be improved.

In the first embodiment, the first switch 20*b*, second hold switch 23*b* and output switch 26 of the pixel circuit 18 are composed of P-channel TFTs. Alternatively, these switches may be composed of N-channel TFTs. Besides, the pixel switch 20*a* and first hold switch 23*a* may be formed of P-channel TFTs or N-channel TFTs if the carriers are the same.

Figures 10, 11:
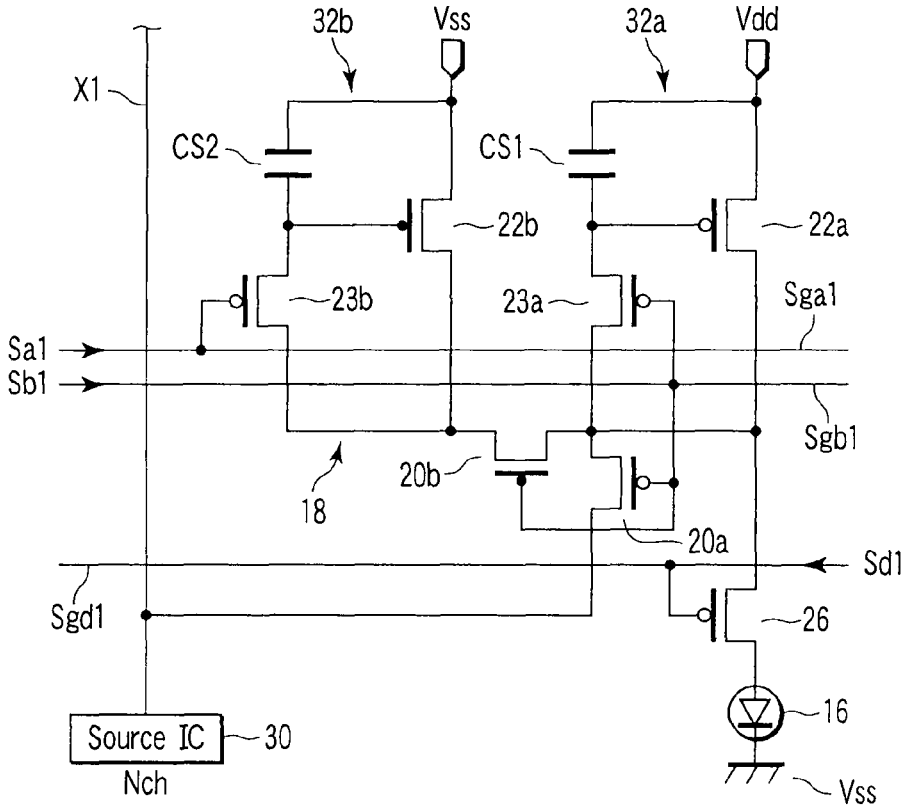
FIG. 10 is a plan view showing an equivalent circuit of a display pixel in an organic EL display device according to a second embodiment of the invention.
FIG. 11 is a table showing on/off (high/low) timings of control signals in the organic EL display device according to the second embodiment.

Next, referring to FIG. 10, a description is given of an organic EL display device according to a second embodiment of the present invention.

According to the second embodiment, in the pixel circuit 18 that constitutes the display pixel PX, the first switch 20*b* is formed of an N-channel TFT and the gate of the first switch 20*b* is connected to the second scanning line Sgb1. As shown in FIG. 11, in the second embodiment, the respective switches are on/off controlled by the control signals. The first switch 20*b* is controlled by the control signal Sgb1 which is common to the pixel switch 20*a* and first hold switch 23*a*.

In the second embodiment, the other structural aspects and operations of the organic EL display device are the same as those described in the first embodiment. The same parts are denoted by like reference numerals, and a detailed description thereof is omitted. In the second embodiment, too, the same advantageous effects as in the first embodiment can be obtained. Further, the number of scanning lines can be reduced, the structure can be simplified, and the manufacturing cost can be reduced.

Figures 12, 13:
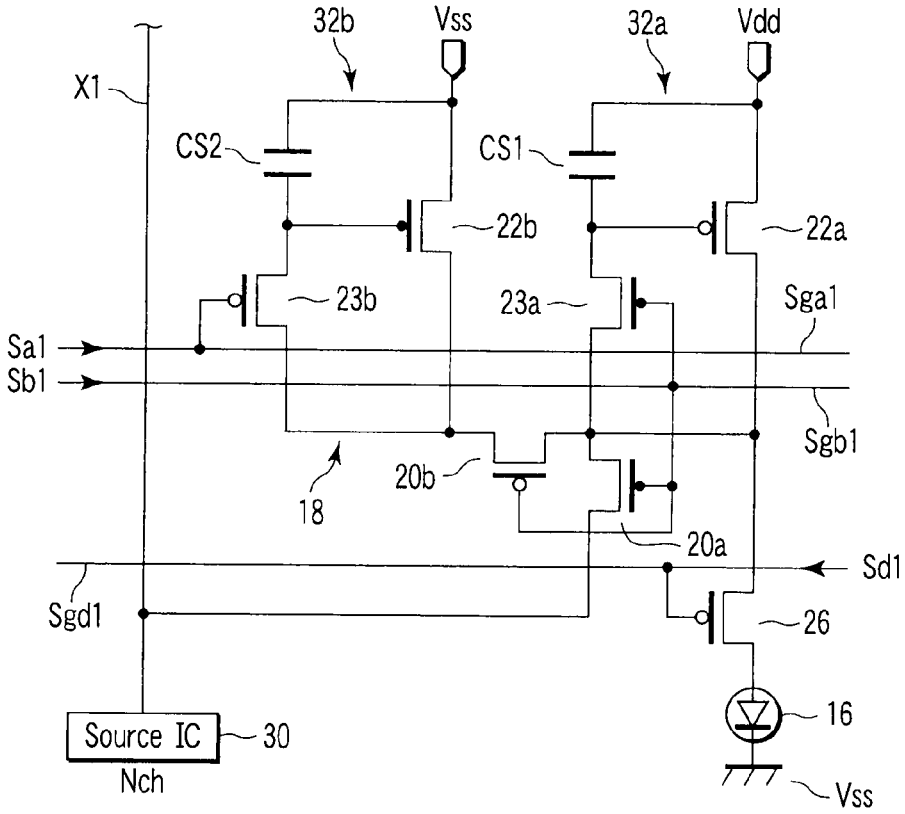
FIG. 12 is a plan view showing an equivalent circuit of a display pixel in an organic EL display device according to a third embodiment of the invention.
FIG. 13 is a table showing on/off (high/low) timings of control signals in the organic EL display device according to the third embodiment.

Next, referring to FIG. 12, a description is given of an organic EL display device according to a third embodiment of the present invention.

According to the third embodiment, in the pixel circuit 18 that constitutes the display pixel PX, the pixel switch 20*a* and the first hold switch 23*a* are formed of N-channel TFTs. The first switch 20*b* is formed of a P-channel TFT and the gate of the first switch 20*b* is connected to the second scanning line Sgb1. As shown in FIG. 13, in the third embodiment, the respective switches are on/off controlled by the control signals. The first switch 20*b* is controlled by the control signal Sgb1 which is common to the pixel switch 20*a* and first hold switch 23*a*.

In the third embodiment, the other structural aspects and operations of the organic EL display device are the same as those described in the first embodiment. The same parts are denoted by like reference numerals, and a detailed description thereof is omitted. In the third embodiment, too, the same advantageous effects as in the first embodiment can be obtained. Further, the number of scanning lines can be reduced, the structure can be simplified, and the manufacturing cost can be reduced.

The present invention is not limited directly to the embodiments described above, and its components may be embodied in modified forms without departing from the spirit of the invention. Further, various inventions may be made by suitably combining a plurality of components described in connection with the foregoing embodiments. For example, some of the components according to the foregoing embodiments may be omitted. Furthermore, components according to different embodiments may be combined as required.

In the above-described embodiments, the semiconductor layer of each thin-film transistor may be formed of not only polysilicon, but also amorphous silicon. The self-luminous element that constitutes the display pixel is not limited to the organic EL element, and various types of self-luminous display elements are applicable.

What is claimed is:

1. An active matrix display device comprising:

a plurality of pixel units arranged in a matrix on a substrate, each of the pixel units including a display element and a pixel circuit which supplies a driving current to the display element;

a plurality of video signal lines connected to columns of the pixel units, respectively; and a signal line driving circuit which supplies a first signal current to the pixel circuit via the video signal line and then supplies a second signal current to the pixel circuit via the video signal line, each of the pixel circuits including a first memory section which stores, in a write period of the pixel unit, a first driving current corresponding to the first signal current and then outputs the stored first driving current, and further stores a second driving current corresponding to the second signal current, and a second memory section which stores the first driving current which is output from the first memory section in the write period of the pixel unit, and each of the pixel circuits being configured to output, in a light emission period of the pixel unit, a difference current between the second driving current stored in the first memory section and the first driving current stored in the second memory section to the display element as the driving current.

2. The active matrix display device according to claim 1, wherein the first memory section includes a first driving transistor which is formed of a P-channel thin-film transistor and outputs the first driving current and the second driving current, and the second memory section includes a second driving transistor which is formed of an N-channel thin-film transistor and outputs the first driving current which is written by the first driving transistor.

3. The active matrix display device according to claim 1, wherein the signal line driving circuit includes an N-channel IC which supplies the first signal current and the second signal current to the first memory section of each of the pixel units via the video signal line.

4. The active matrix display device according to claim 2, wherein each of the pixel circuits includes a pixel switch which controls selection/non-selection of the pixel unit, and an output switch which is connected between voltage power supplies in series to the display element and the first and second driving transistors, the first memory section includes a first storage capacitance which stores a potential between a source and a gate of the first driving transistor, and a first hold switch which is formed of a transistor, is connected to the gate and a drain of the first driving transistor, and controls turn-on/turn-off of the first driving transistor, and the second memory section includes a second storage capacitance which stores a potential between a source and a gate of the second driving transistor, a second hold switch which is formed of a transistor, is connected to the gate and a drain of the second driving transistor, and controls turn-on/turn-off of the second driving transistor, and a first switch which is formed of a transistor and is connected to the drain of the first driving transistor and the source of the second driving transistor, the pixel switch being connected to the first hold switch and the video signal line.

5. The active matrix display device according to claim 4, wherein the pixel switch and the first hold switch are formed of P-channel thin-film transistors and are opened/closed by a common control signal.

6. The active matrix display device according to claim 4, wherein the first switch is formed of an N-channel thin-film transistor and is opened/closed by a control signal which is common to the pixel switch and the first hold switch.

7. The active matrix display device according to claim 4, wherein the pixel switch and the first hold switch are formed of N-channel thin-film transistors and are opened/closed by a common control signal.

8. The active matrix display device according to claim 7, wherein the first switch is formed of a P-channel thin-film transistor and is opened/closed by a control signal which is common to the pixel switch and the first hold switch.

9. The active matrix display device according to claim 4, wherein the transistor, the first driving transistor and the second driving transistor are formed of thin-film transistors in which polysilicon is used for semiconductor layers.

10. The active matrix display device according to claim 1, wherein the display element is a self-luminous display element including an organic light-emitting layer between opposed electrodes.

* * * * *

UNITED STATES PATENT AND TRADEMARK OFFICE

CERTIFICATE OF CORRECTION

PATENT NO. : 8,094,110 B2
APPLICATION NO. : 11/944967
DATED : January 10, 2012
INVENTOR(S) : Kazuyoshi Omata et al.

It is certified that error appears in the above-identified patent and that said Letters Patent is hereby corrected as shown below:

On the title page, Item (73), the Assignee's name is incorrect. Item (73) should read:

-- (73) Assignee: Toshiba Matsushita Display Technology Co., Ltd., Tokyo (JP) --

Signed and Sealed this
Sixth Day of March, 2012

David J. Kappos

David J. Kappos
*Director of the United States Patent and Trademark Office*